US007856201B2

(12) United States Patent
Takagaki et al.

(10) Patent No.: US 7,856,201 B2
(45) Date of Patent: Dec. 21, 2010

(54) IMAGE TRANSFER FIXATION APPARATUS AND IMAGE FORMATION APPARATUS

(75) Inventors: Hiromitsu Takagaki, Yokohama (JP); Takashi Fujita, Yokohama (JP); Shin Kayahara, Yokohama (JP); Takashi Seto, Yokohama (JP); Atsushi Nagata, Atsugi (JP); Takeshi Takemoto, Yamato (JP); Kazumi Suzuki, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 71 days.

(21) Appl. No.: 12/289,392

(22) Filed: Oct. 27, 2008

(65) Prior Publication Data

US 2009/0116880 A1 May 7, 2009

(30) Foreign Application Priority Data

Nov. 5, 2007 (JP) ..... 2007-287264

(51) Int. Cl.
*G03G 15/20* (2006.01)

(52) U.S. Cl. ..... 399/307; 399/67

(58) Field of Classification Search ..... 399/307, 399/67, 68, 320, 341, 401; 430/124.11
See application file for complete search history.

(56) References Cited

U.S. PATENT DOCUMENTS

| | | | | |
|---|---|---|---|---|
| 5,689,786 | A * | 11/1997 | Tokunaga et al. | 399/307 |
| 6,377,773 | B1 * | 4/2002 | Berkes et al. | 399/307 |
| 6,393,245 | B1 * | 5/2002 | Jia et al. | 399/307 |
| 7,031,648 | B2 | 4/2006 | Takashi et al. | 399/307 |
| 7,127,202 | B2 | 10/2006 | Fujita et al. | 399/307 |
| 7,233,762 | B2 | 6/2007 | Kunii et al. | 399/307 |
| 7,254,362 | B2 | 8/2007 | Kikuchi et al. | 399/333 |
| 7,269,384 | B2 | 9/2007 | Someya et al. | 399/307 |
| 7,299,003 | B2 | 11/2007 | Kurotaka et al. | 399/329 |
| 7,333,760 | B2 | 2/2008 | Baba et al. | 399/307 |
| 7,359,666 | B2 | 4/2008 | Takashi et al. | 399/329 |
| 7,369,803 | B2 | 5/2008 | Echigo et al. | 399/328 |
| 2004/0037595 | A1 | 2/2004 | Takashi et al. | 399/307 |
| 2005/0025534 | A1 | 2/2005 | Fujita et al. | 399/307 |
| 2005/0152721 | A1 | 7/2005 | Kikuchi et al. | 399/333 |

(Continued)

FOREIGN PATENT DOCUMENTS

| | | |
|---|---|---|
| JP | 10-063121 | 3/1998 |

(Continued)

*Primary Examiner*—Sophia S Chen
(74) *Attorney, Agent, or Firm*—Harness, Dickey & Pierce, P.L.C.

(57) ABSTRACT

A transfer fixation apparatus includes: a fixing member that carries the toner image; a pressurizing member that becomes in contact with the fixing member with pressure to form a nip through which the recording target medium is transported; and a plurality of heating members that are provided at relatively upstream positions when viewed from the relatively downstream nip and apply heat to the surface of the recording target medium that is transported toward the nip, wherein the number of heating members that apply heat to the surface of the recording target medium is changed depending on whether the transfer of the toner image is performed only on the front side of the recording target medium or the transfer of the toner image is performed also on the reverse side of the recording target medium after the transfer of the toner image on the front side of the recording target medium.

10 Claims, 8 Drawing Sheets

U.S. PATENT DOCUMENTS

| | | | | |
|---|---|---|---|---|
| 2005/0201783 | A1 | 9/2005 | Kurotaka et al. | 399/329 |
| 2005/0207801 | A1 | 9/2005 | Kunii et al. | 399/307 |
| 2005/0238373 | A1* | 10/2005 | Takayanagi | 399/307 X |
| 2005/0286920 | A1 | 12/2005 | Baba et al. | 399/69 |
| 2006/0008302 | A1 | 1/2006 | Someya et al. | 399/307 |
| 2006/0013624 | A1 | 1/2006 | Kurotaka et al. | 399/329 |
| 2006/0019082 | A1 | 1/2006 | Kikuchi et al. | 428/295.1 |
| 2006/0088349 | A1 | 4/2006 | Someya et al. | 399/328 |
| 2006/0120776 | A1 | 6/2006 | Takashi et al. | 399/307 |
| 2006/0140689 | A1 | 6/2006 | Echigo et al. | 399/328 |
| 2007/0065188 | A1 | 3/2007 | Takagaki et al. | 399/307 |
| 2007/0071511 | A1 | 3/2007 | Suzuki et al. | 399/307 |
| 2007/0104520 | A1 | 5/2007 | Nakafuji et al. | 399/329 |
| 2007/0212126 | A1 | 9/2007 | Seto et al. | 399/302 |
| 2007/0212129 | A1 | 9/2007 | Takemoto et al. | 399/313 |
| 2007/0218386 | A1 | 9/2007 | Suzuki et al. | 430/108.4 |
| 2008/0008505 | A1 | 1/2008 | Seto et al. | 399/307 |
| 2008/0069606 | A1 | 3/2008 | Yamashita et al. | 399/307 |
| 2008/0069610 | A1 | 3/2008 | Nakafuji et al. | 399/329 |
| 2008/0219717 | A1* | 9/2008 | Kayahara et al. | 399/307 |
| 2008/0219718 | A1* | 9/2008 | Fujita et al. | 399/307 |

FOREIGN PATENT DOCUMENTS

| | | |
|---|---|---|
| JP | 2004-145260 | 5/2004 |
| JP | 2005-037879 | 2/2005 |

* cited by examiner

IMAGE TRANSFER FIXATION APPARATUS AND IMAGE FORMATION APPARATUS

BACKGROUND OF THE INVENTION

1. Field of the Invention

The present invention relates to an image transfer fixation apparatus that adopts at least a certain image transfer system/scheme among a variety of image transfer systems/schemes, and an image formation apparatus that is provided with such an image transfer fixation apparatus. A few examples of such an image transfer fixation apparatus and an image formation apparatus include but not limited to a copier, a printer, a facsimile, and a multi-function apparatus that has a combined function of any or all of those enumerated above.

2. Description of the Related Art

In the technical field to which the present invention pertains, an image formation apparatus is widely known. An example of an image formation apparatus known in the art performs image transfer and image fixation as follows. An image is formed on a photosensitive member, which functions as an image carrier. The image that is formed on the photosensitive member is transferred to an intermediary image transfer member by means of a primary image transfer unit. The image that is transferred onto the intermediary image transfer member is further transferred to a certain image transfer target matter/object with the use of a secondary image transfer unit. Thereafter, the image is fixed thereon by means of a certain image fixation unit. A conventional image formation apparatus typically performs image transfer and image fixation as two individual steps, which are executed separately from each other. Recently, however, an image formation apparatus that is provided with a so-called image transfer fixation apparatus and performs image transfer and image fixation at the same time and/or as a single step has been proposed. There are some types of image transfer fixation that have been proposed by the related art so far. An image formation apparatus that is provided with an image transfer fixation apparatus of related art performs secondary image transfer fixation by transferring an image from an intermediary image transfer member onto an image transfer target matter and fixing the image thereon. Another image formation apparatus that is provided with another image transfer fixation apparatus of related art performs secondary image transfer by transferring an image from an intermediary image transfer member onto an image transfer fixation member and thereafter performs tertiary image transfer as well as image fixation by transferring the image from the image transfer fixation member onto an image transfer target matter and fixing the image thereon. In both types of the related-art image transfer fixation described above, fine particles that have electrification characteristics and are mainly made of a resin called as toner are typically used.

In the operation flow of an electro-photographic image formation apparatus, it is the step of transferring an image onto an image transfer target matter that has considerable influence upon the quality of an image formed thereon. Paper is usually used as an image transfer target matter. There are various thickness types thereof including standard paper and thick paper, without any limitation thereto. In addition, there are various surface types thereof. Some of them are smooth, while others are rough. Especially when a sheet of printing paper that has a rough surface is used, the surface of an intermediary image transfer member cannot perfectly fit with the minute convexes and concaves of such rough paper. Accordingly, fine gaps are formed at such irregular minute spots. Because of these fine gaps, abnormal electrical discharge occurs thereat, which makes it practically impossible or at best difficult for an image to be transferred in a fine and faithful manner. For this reason, the quality of an image formed thereon is likely to be poor and lacking in fine fidelity when viewed as a whole.

In contrast, the second-mentioned type of an image formation apparatus of related art, which performs secondary image transfer by transferring an image from an intermediary image transfer member onto an image transfer fixation member and thereafter performs tertiary image transfer as well as image fixation by transferring the image from the image transfer fixation member onto an image transfer target matter and fixing the image thereon, makes it possible to effectively prevent the deterioration of image quality explained above even in a case where a sheet of printing paper that has a rough surface is used because image transfer and image fixation are performed at the same time and/or as a single step. Specifically, the reason why it is possible to effectively prevent the deterioration of image quality even for such rough paper is that toner becomes softened and/or melted through heating that is performed concurrently with image transfer so as to turn into agglomerate blocks having viscoelasticity, which makes it possible to achieve the successful transfer of such viscoelastic toner agglomerates for portions of an image corresponding to the minute convexes and concaves (i.e., fine gaps) of the image transfer target paper. For this reason, an image formation apparatus that is provided with an image transfer fixation apparatus has an advantage over an image formation apparatus that is not provided therewith in terms of image quality.

In addition, in the steps of the image transfer fixation method, there does not occur a state in which fine particles are placed on an image transfer target matter. For this reason, the image transfer fixation method has another advantage in that it is possible to provide a paper transport guide having a narrow width up to immediately before image transfer fixation. Thus, it is possible to ensure stable and reliable paper transport irrespective of paper types inclusive of thin paper and thick paper. That is, if the image transfer fixation method is used, it is possible to use a variety of paper for printing. Moreover, with the image transfer fixation method, it is possible to effectively reduce the rate of occurrence of paper jam errors and/or malfunctions.

In the image transfer fixation process explained above, the improvement of thermal efficiency is an important factor for excellent image transfer. In order to improve thermal efficiency, it is effective to raise interface temperature, that is, temperature between the surface of a sheet of recording paper and toner that adhere to each other. Conventionally, toner has been pre-heated well for the softening thereof. Then, the softened toner is fixed thereon through the application of pressure thereto. However, such a conventional method in which toner only is heated has a disadvantage in that it is practically impossible or at best difficult to achieve satisfactory thermal efficiency in a case where, for example, an image transfer fixation member has a large thickness such as 300 μm or so or in a case where a quad tandem full color image formation system that has a large perimeter is adopted. Especially, since a cooling step is required after an image transfer step, there is a lot of waste in terms of energy efficiency; that is, it is necessary to heat a target object and then cool the same target object.

In an effort to overcome such a disadvantage, there has been proposed a technique of heating the surface of a sheet of printing paper immediately before it becomes in contact with toner. Since not only the front side of a sheet of recording paper but also the reverse side thereof are heated in the above-mentioned proposed technique of the related art, the proposed technique cannot achieve high energy efficiency. Moreover, many outstanding problems remain unsolved, including but not limited to, the possible ignition of paper in a heating process, temperature unevenness, and scumming due to overheating.

SUMMARY OF THE INVENTION

In order to address the above-identified problems without any limitation thereto, the invention provides, as an aspect thereof, a transfer fixation apparatus for transferring a toner image onto a recording target medium and fixing the toner image on the recording target medium, including: a fixing member that carries the toner image; a pressurizing member that becomes in contact with the fixing member with pressure so as to form a nip through which the recording target medium is transported; and a heating section that is made up of a plurality of heating members that are provided at relatively upstream positions when viewed from the relatively downstream nip and apply heat to the surface of the recording target medium that is transported toward the nip, wherein the number of heating members that apply heat to the surface of the recording target medium is changed depending on whether the transfer of the toner image is performed only on the front side of the recording target medium or the transfer of the toner image is performed also on the reverse side of the recording target medium after the transfer of the toner image on the front side of the recording target medium.

BRIEF DESCRIPTION OF THE DRAWINGS

FIG. 3A shows an example of the positions/arrangement of a recording target medium and the heating means; whereas FIG. 3B shows, in an enlarged sectional view, an example of the structure of the heating means;

FIG. 4A shows another example of the positions/arrangement of a recording target medium and the heating means; whereas FIG. 4B shows, in an enlarged sectional view, another example of the structure of the heating means;

DESCRIPTION OF THE PREFERRED EMBODIMENTS

Figure 1:
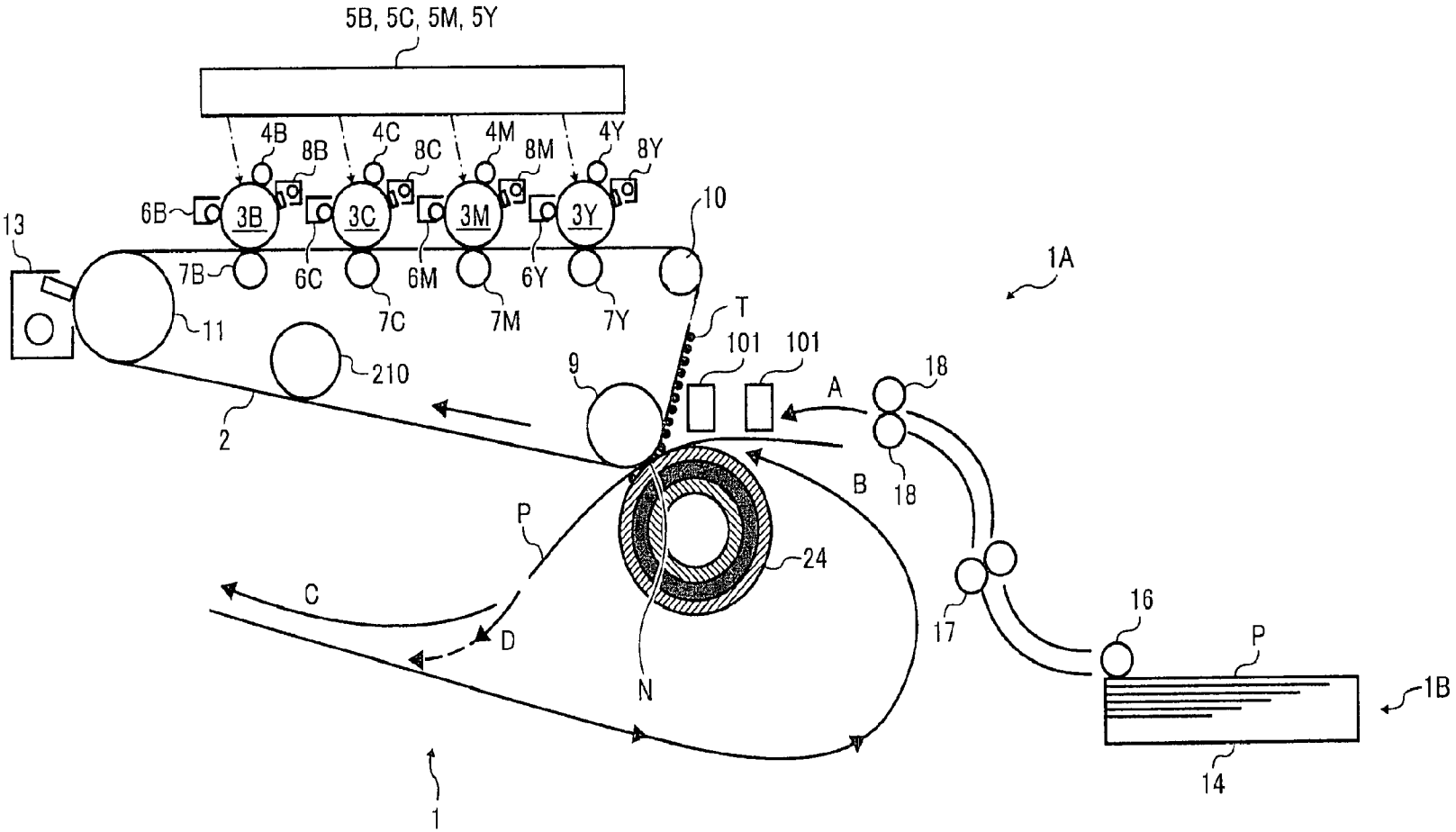
FIG. 1 is a diagram that schematically illustrates an example of the configuration of an image formation apparatus that is provided with an image transfer fixation apparatus according to an exemplary embodiment of the invention.

With reference to the accompanying drawings, exemplary embodiments of the present invention are explained in detail below. It should be noted that, in the accompanying drawings as well as in the following description of exemplary embodiments of the invention, the same reference numerals are consistently used for the same or corresponding components so as to omit, if appropriate, any redundant explanation or simplify explanation thereof.

First Embodiment

FIG. 1 is a diagram that schematically illustrates an example of the configuration of a tandem color copy machine. The tandem color copy machine shown in FIG. 1 is an example of an image formation apparatus that is provided with an image transfer fixation apparatus according to an exemplary embodiment of the invention. An image formation apparatus 1 includes an image formation unit 1A, a paper feeder unit 1B, and an image reader unit. The image formation unit 1A, which is an image-forming portion, is provided at the center of the image formation apparatus 1. The paper feeder unit 1B, which is a paper-feeding portion, is provided below/under the image formation unit 1A. The image reader unit, which is an image-reading portion, is provided above/over the image formation unit 1A. Note that the image reader unit is not shown in the drawing. It is assumed that the image formation apparatus 1 according to the present embodiment of the invention is capable of forming an image at a line speed of 200 mm/s.

An image transfer fixation belt 2, which has an intermediary image transfer function, is provided as a component/member of the image formation unit 1A. The image transfer fixation belt 2 has an image transfer surface that extends in a horizontal direction. A set of image formation components/members that is used for forming images of complementary colors with respect to color-separation colors is provided on the upper surface of the image transfer fixation belt 2. More specifically, photosensitive members 3Y, 3M, 3C, and 3B, which function as image carriers that are capable of carrying toner images of complementary colors, that is, yellow (Y), magenta (M), and cyan (C) as well as black (B, or K), respectively, are provided in a line along the image transfer surface of the image transfer fixation belt 2.

The image transfer fixation belt 2 has a multilayer structure. A preferred example of such a multilayer structure includes polyimide resin as a base material, and in addition, rubber and fluorocarbon resin. In such a preferred multilayer structure, the film thickness of the base polyimide resin is 40 μm. The film thickness of the rubber is preferably 60 μm whereas the film thickness of the fluorocarbon resin is preferably 60 μm. The rubber layer is necessary for ensuring good fit and thus excellent image transfer even when the surface of a recording target medium such as a sheet of printing paper, which is the target of image formation, is not smooth. The fluorocarbon resin surface layer contributes to good toner release and paper-dust release.

Each of the photosensitive members 3Y, 3M, 3C, and 3B has a drum structure. These photosensitive drums 3Y, 3M, 3C, and 3B can rotate in the same direction as one another. Electrostatic charging units 4Y, 4M, 4C, and 4B, writing units 5Y, 5M, 5C, and 5B, developing units 6Y, 6M, 6C, and 6B, primary image transfer units 7Y, 7M, 7C, and 7B, and photosensitive member cleaning units 8Y, 8M, 8C, and 8B are provided around the photosensitive members 3Y, 3M, 3C, and 3B, respectively. The electrostatic charging units 4Y, 4M, 4C, and 4B, which are static electrification units, perform image formation processing in a roller rotation process. The writing units 5Y, 5M, 5C, and 5B function as an optical writer. Each of the developers 6Y, 6M, 6C, and 6B has a toner container for the corresponding color. It should be noted that each of the alphabets Y, M, C, and B that follow each reference numeral used herein denotes the corresponding one of toner colors, as in the denotation of the photosensitive members 3Y, 3M, 3C, and 3B mentioned above.

The image transfer fixation belt 2 is wound around a driving roller 11, which is a master roller, and driven rollers 9 and 10, each of which is a slave roller that follows the rotation of the master roller 11. Having a rotary belt configuration, the image transfer fixation belt 2 can move in the same direction as the rotation direction thereof at a position in contact with the photosensitive members 3Y, 3M, 3C, and 3B. A belt cleaner unit 13, which cleans the surface of the image transfer fixation belt 2, is provided opposite to the driving roller 11.

Next, a series of image formation steps that is performed with the use of the image formation apparatus 1 having the configuration described above is explained. In the following description, yellow toner image formation process that is executed by means of the yellow photosensitive member 3Y is taken as an example. As a first step of the yellow toner image formation process, the yellow electrostatic charging unit 4Y electrifies the surface of the yellow photosensitive member 3Y in a uniform manner. As a result thereof, an electrostatic latent image is formed on the surface of the yellow photosensitive member 3Y on the basis of image information that is supplied from the aforementioned image reader unit. Next, the yellow developing unit 6Y, which contains yellow toner, visualizes the electrostatic latent image that is formed on the surface of the yellow photosensitive member 3Y so as to form a yellow toner image thereon. Then, the yellow primary image transfer unit 7Y to which a predetermined bias is applied transfers the yellow toner image onto the image transfer fixation belt 2. This image transfer constitutes a primary image transfer step. The same image formation and transfer as above is performed for other three photosensitive members 3M, 3C, and 3B.

After the completion of primary image transfer, each of the photosensitive member cleaning units 8Y, 8M, 8C, and 8B removes any unused toner that remains on the surface of the corresponding one of the photosensitive members 3Y, 3M, 3C, and 3B. Thereafter, a diselectrification lamp, for example, an erase lamp, initializes the potential of each of the photosensitive members 3Y, 3M, 3C, and 3B as preparation for the next formation of an image thereon. Note that the diselectrification lamp is not illustrated in the drawing.

A pressurizing member 24 is provided opposite to the driven roller 9. Hereafter, the pressurizing member 24 is referred to as a pressure roller 24. The pressure roller 24 and the image transfer fixation belt 2 form a nip N therebetween. In the following description of this specification, the nip N may be referred to as "image transfer nip". The pressure roller 24 has, for example, a releasing surface layer that is coated on the surface of a metal pipe such as an aluminum pipe.

Heating means 101 such as a plurality of heaters is provided at an upstream pressure-roller-side position that is immediately before, that is, immediately in front of, an image transfer fixation position at which an image is transferred on a recording target medium P such as a sheet of printing paper. The term "upstream" is used herein as viewed in the direction of paper transportation, or, in comparison with the image transfer fixation position, which is a downstream position. The phrase "immediately before" is also used herein as viewed in the direction of paper transportation. The heating means 101 has a function of applying heat to the surface of the recording target medium P.

A low friction material layer that is made of fluorocarbon resin or the like may be provided on the contact surface of the heating means 101, which becomes in contact with a recording target medium P, in order to ensure smooth sliding operation thereof. It is preferable that the low friction material layer should have a thickness of a few micrometers (μm) or so. The heating temperature of the heating means 101 is controlled within a range of approximately 140-200° C. Being controlled in such a temperature range, the heating means 101 applies heat to the surface of a recording target medium, that is, a sheet of printing paper. A thermoelectric couple having a diameter of 20 μm is fixedly mounted on the reverse side of a sheet of printing paper in order to experimentally verify a temperature change thereat in a heating process. As the results of the experiment, it was confirmed that a temperature change that occurs on the back of printing paper, which is measured in a measurement time period of 0-20 ms after the contacting of the heating means 101 with the printing paper, does not exceed 5° C. In this experiment, widely used copy paper (copy paper 6200 of Ricoh Co., Ltd.) was used. In addition, it is desirable to make the length of contact time during which the image transfer fixation belt 2 is in contact with the pressure roller 24 as short as possible because, if so configured, less heat is taken away from the image transfer fixation belt 2 as a result of the absorption thereof by the pressure roller 24, which results in more efficient image transfer and image fixation, that is, toner fixation. That is, the shorter the contact time, the more efficient the image transfer fixation.

The paper feeder unit 1B has a printing paper tray 14, a paper pickup roller 16, a pair of paper transport rollers 17, and a pair of "resist" rollers 18. A plurality of recording target media such as sheets of printing paper P is stacked/set on the paper tray 14. The paper pickup roller 16 picks up the uppermost sheet of the stacked printing paper P in sequential pickup operation, that is, one after another, while separating the uppermost pickup target sheet from the second and subsequent sheets counted from the top at each pickup operation. The pair of paper transport rollers 17 transports the sheet of printing paper P that has been fed thereto. At the pair of resist rollers 18, the transportation of the sheet of printing paper P is temporarily stopped for the purpose of correcting paper skew, if any. Thereafter, the pair of resist rollers 18 transports the sheet of printing paper P toward the nip N at such a timing that makes the front edge of an image that is formed on the image transfer fixation belt 2 is aligned with a predetermined position when viewed in the direction of paper transportation.

A toner image T, which may be hereafter simply referred to as "toner", is primarily transferred from each of the aforementioned photosensitive members 3Y, 3M, 3C, and 3B to the image transfer fixation belt 2 due to electrostatic force through the application of a bias to the driven roller 11 by a certain bias applying means. The bias includes AC superposition, pulse superposition, and the like.

The image formation apparatus 1 shown in FIG. 1 is provided with a belt temperature equalization roller 210, which makes the temperature of the image transfer fixation belt 2 uniform. The belt temperature equalization roller 210 is provided between an image transfer unit that is provided for the image transfer fixation belt 2 and another image transfer unit that is provided for the most upstream photosensitive member 3B. The belt temperature equalization roller 210 is made of a heat pipe or a material that has high thermal conductivity such as graphite or the like. The belt temperature equalization roller 210 is configured to rotate while being in contact with the image transfer fixation belt 2. The belt temperature equalization roller 210 may double as a heat pipe for the driving roller 11.

The toner image T that has been transferred to the image transfer fixation belt 2 receives heat from the heat capacity of a recording target medium P until the toner image T is fixed on the recording target medium P at the nip N. In order to obtain/ensure a satisfactory gloss/brilliance, conventional color image formation apparatuses require heat quantity that is 1.5 times larger than that of conventional monochrome image formation apparatuses in consideration of a temperature decrease that is attributable to a recording target medium. For this reason, overheating tends to make the adhesion of toner to a recording target medium excessively high.

In the configuration of the image formation apparatus 1 according to the present embodiment of the invention, a plurality of heating members (i.e., heaters) 101, which make up the aforementioned heating means 101, is provided on the transportation channel/route/path of the recording target medium P. The heating means 101 may include a plurality of heating members that are separated from each other or one another as viewed in the width direction of a recording target medium, which is a non-limiting exemplary configuration thereof. It is preferable that the plurality of heating members should be configured in such a manner that they can operate independently of each other or one another. With such a configuration, it is possible to easily control heating temperature depending on the thickness of a recording target medium. In addition, it is further possible to easily control heating temperature depending on whether single side printing or double side printing is performed. That is, it is possible to appropriately set the surface temperature of a recording target medium P; and in addition, it is possible to achieve efficient image fixation without increasing the temperature of the image transfer fixation belt 2.

Moreover, since the apparatus performs image formation in relatively low apparatus-temperature conditions, it is possible to shorten the length of a so-called warm-up period, which offers excellent energy conservation characteristics. In addition, such low temperature image formation makes it possible to prevent heat from transferring to an image-forming portion/unit, thereby making it further possible to avoid the thermal deterioration of parts. Thus, the apparatus has improved durability.

Second Embodiment

Figure 2:
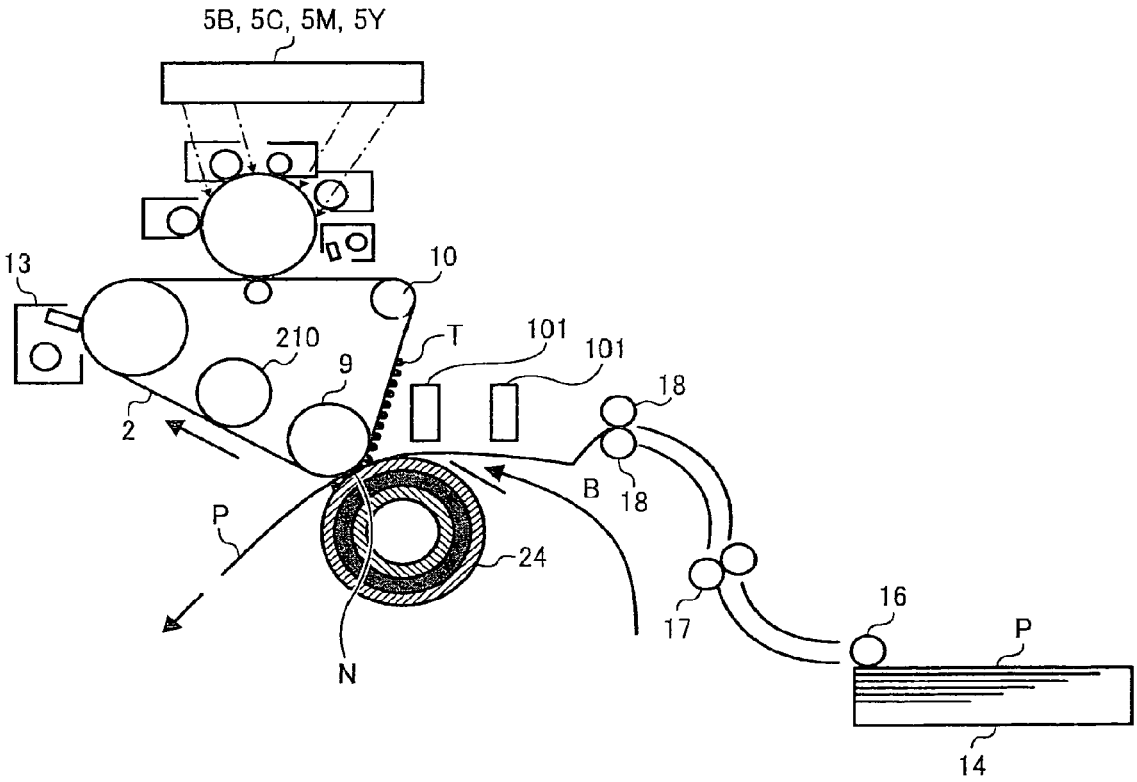
FIG. 2 is a diagram that schematically illustrates an example of the configuration of an image formation apparatus that is provided with an image transfer fixation apparatus according to another exemplary embodiment of the invention.

Next, with reference to FIG. 2, an image transfer fixation apparatus according to a second embodiment of the invention as well as an image formation apparatus that is provided with the image transfer fixation apparatus according to the second embodiment of the invention is explained below. The image formation apparatus illustrated in FIG. 2 is an example of a so-called IOI (image-on-image) color copy machine. In the operation of an IOI color copy machine, a color-superposed image is formed on a single photosensitive member thereof by superposing an image corresponding to one color on an image corresponding to another color. Then, the color-superposed image is transferred to an intermediary image transfer member. In the configuration of the image formation apparatus illustrated in FIG. 2, the same reference numerals are consistently used for the same components as those of the image formation apparatus 1 according to the first embodiment of the invention, which has been explained above while referring to FIG. 1, so as to omit any redundant explanation thereof.

The IOI image formation apparatus illustrated in FIG. 2, which forms a color-superposed image on a single photosensitive member thereof by superposing an image corresponding to one color on an image corresponding to another color, executes a series of image formation process on the single photosensitive member for each toner color component. The series of image formation process includes an electrification step, an exposure step (i.e., writing step), and a development step. As has been explained above while referring to FIG. 1, the non-IOI image formation apparatus 1 according to the first embodiment of the invention has an individual photosensitive member for each toner color component. Having such a set of individual photosensitive members, the non-IOI image formation apparatus 1 according to the first embodiment of the invention forms an image for each toner color component on the corresponding photosensitive member. In comparison with such a non-IOI configuration of the image formation apparatus 1 according to the first embodiment of the invention, the IOI image formation apparatus according to the second embodiment of the invention features faster response. In addition, the IOI image formation apparatus according to the second embodiment of the invention has an advantage in that it occupies a smaller space for installation. Moreover, the IOI image formation apparatus according to the second embodiment of the invention further has a cost reduction advantage.

EXAMPLES

Next, an explanation is given of examples of image formation that is performed by an image formation apparatus according the first embodiment of the invention, which has an exemplary configuration shown in FIG. 1, or by an image formation apparatus according the second embodiment of the invention, which has an exemplary configuration shown in FIG. 2. In the following description, we focus attention on the function of the heating means 101.

First Example

Figure 3A:
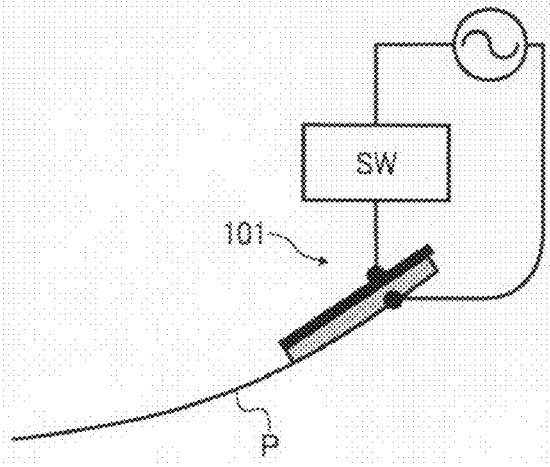
FIGS. 3A and 3B are a set of diagrams that schematically illustrates an example of heating means; specifically.
Figure 3B:
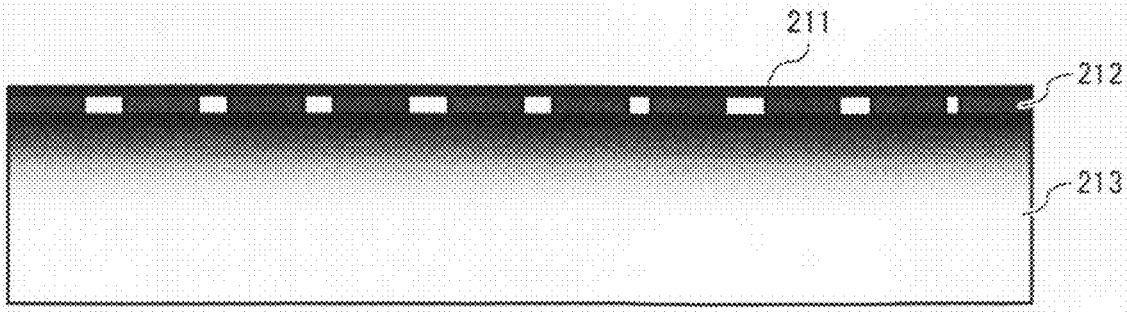

FIG. 3A is a diagram that schematically illustrates an example of the positions/arrangement of a recording target medium P and the heating means (e.g., heaters) 101. FIG. 3B is an enlarged sectional view that schematically illustrates an example of the configuration of the heating means 101, which is viewed from the paper-feeding side. It should be noted that the position of the heating means 101 is not limited to that illustrated in FIG. 3A. The heating means 101 has a function of applying heat to the surface of a recording target medium P. When the heating means 101 applies heat to the recording target medium P, the heating means 101 may be in contact with the recording target medium P or may not be in contact therewith. It is preferable that the heating means 101 should include a plurality of heating members that are separated from each other or one another. As a non-limiting example of the configuration thereof, the heating means 101 has ten positive temperature coefficient thermistors 212 that are provided adjacent to one another, that is, arrayed in a line. Each of these ten positive temperature coefficient thermistors 212 is made of, for example, barium titanate series semiconducting ceramic element. The weight of the heating means 101 is approximately 25 g. The positive temperature coefficient thermistors 212 are sandwiched between a respective electrodes 211-1 to 211-10, for example, and a heat exchanger plate 213. The heat exchanger plate 213 functions also as an electrode. Each of the electrodes 211-1 to 211-10 and the heat exchanger plate 213 may be made of SUS, for example. Upon the application of a voltage of AC 100V to these electrodes 211-1 to 211-10 and the heat exchanger plate 213 via a switch (SW) (i.e., SW1 . . . SW10), the heating means 101 becomes heated. The semiconductor mentioned above has Curie point temperature of 200° C. As the temperature exceeds the Curie point, an inter-electrode resistance increases sharply. Accordingly, a current level is reduced to a half (½) at 210° C. It decreases to a quarter (¼) at 220° C. For example, as the results of an experiment, the temperature thereof increased up to 190-200° C. in six seconds with the supply/application of 1200 W power. The temperature went up to 210° C. thereafter in a stable manner. Since the positive temperature coefficient thermistors 212 are provided/connected adjacent to one another, it is possible to correctly control the temperature of each thereof at 200° C. Thus, it is possible to ensure that temperature variation in the direction of the width of recording paper does not exceed 10° C. The length of a contact time period during which the heating means 101 is in contact with the surface of a sheet of printing paper, or the length of an approach time period during which the heating means 101 comes very close to the surface of a sheet of printing paper, was set at 10-20 ms. Then, after the lapse of 2-5 ms, the printing paper was subjected to pressurization at the nip. Under the experimental conditions explained above, it was confirmed that both image fixation performance and color development performance are quite satisfactory for practical use. The EA-HG toner that is manufactured by Xerox Corporation and the P×P toner that is manufactured by Ricoh Co., Ltd. were used in the experiment.

Figure 4A:
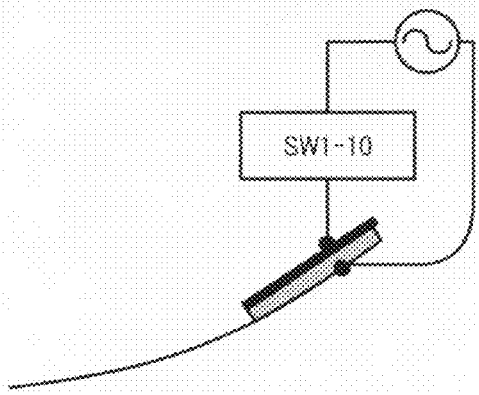
FIGS. 4A and 4B are a set of diagrams that schematically illustrates another example of heating means; specifically.
Figure 4B:
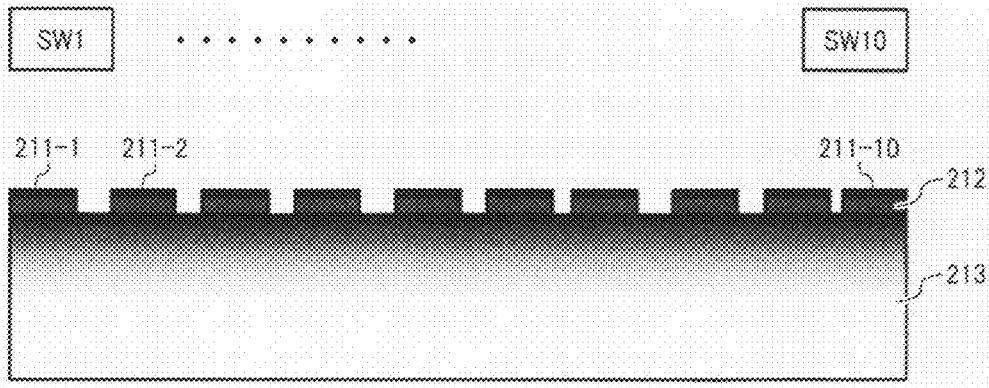

A set of common electrodes may be provided for a plurality of thermistors, which make up the heating means 101, as illustrated in FIG. 3. However, the configuration of the heating means 101 is not limited thereto. For example, an individual electrode may be provided for each of the plurality of thermistors. In such a modified configuration, power is applied on an individual basis. An example of such a modified configuration is illustrated in FIGS. 4A and 4B.

Figure 5:
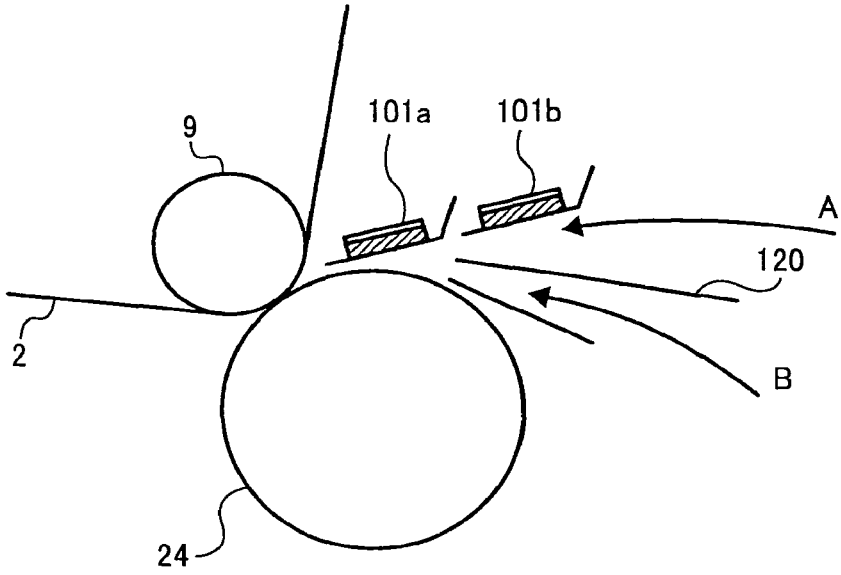
FIG. 5 is a diagram that schematically illustrates an example of the partial configuration of an image formation apparatus in the neighborhood of a nip where a plurality of heating members is provided.

FIG. 5 is a diagram that schematically illustrates an example of the positional relationships between the "feed-in" route of a sheet of printing paper and the heating means 101 in the neighborhood of the nip at which image transfer and image fixation, that is toner fixation, are performed. In the illustrated exemplary configuration, the heating means (e.g., heaters) 101 is provided at two relatively upstream positions (101*a* and 101*b*) when viewed from the nip, which is formed at a relatively downstream position, in the direction of transportation of a sheet of printing paper. Hereafter, the heating means 101 may be referred to as a pair of heaters 101*a* and 101*b*. For example, when printing is performed on one face of a sheet of recording paper, the sheet of recording paper travels on a one-side printing paper transportation channel (i.e., route or path) that is shown by an arrow A in FIG. 5. The sheet of recording paper becomes in contact with the heater 101*b* or comes very close thereto. As a result thereof, the surface of the sheet of printing paper is heated. As the sheet of printing paper further moves forward, it becomes in contact with the heater 101*a* or comes very close thereto. As a result thereof, the surface of the sheet of printing paper is further heated. Thereafter, an image is transferred and fixed on the sheet of printing paper at the nip. When printing is performed only on one side of a sheet of recording paper, that is, not on both of two faces thereof, the print-completed paper is ejected in the direction C shown in FIG. 1. Then, one-side printing operation ends.

On the other hand, when printing is performed on both faces of a sheet of recording paper, after the completion of single side printing as explained above, the sheet of printing paper is transported in the direction D that is shown in FIG. 1. Thereafter, the transportation direction of the sheet of printing paper is switched back. After the switchback, the sheet of printing paper is transported in the direction B shown therein. Then, the sheet of printing paper is fed again into the image transfer unit/portion. When the sheet of printing paper is fed again into the image transfer unit for the reverse-side printing, as shown in FIG. 5, surface heating is performed in such a manner that it does not become in contact with the heater 101*b* or does not come very close to the heater 101*b*. That is, surface heating is performed in such a manner that it becomes in contact with the heater 101*a* only or comes very close to the heater 101*a* only. It is preferable that a paper transport guide 120 should be provided so as to guide the sheet of recording paper. The paper transport guide 120 prevents the sheet of recording paper from becoming in contact with the heater 101*b* or coming very close to the heater 101*b*.

Figure 6:
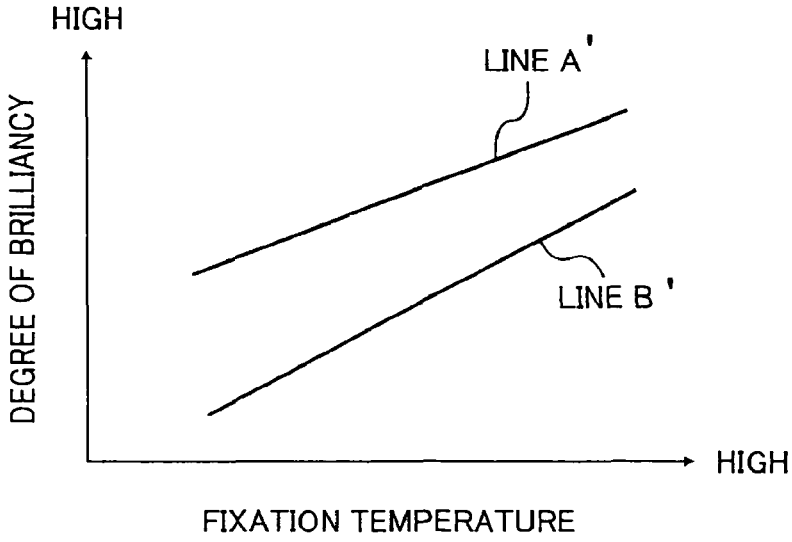
FIG. 6 shows relationships between surface temperature in an image transfer fixation process and the degree of brilliancy of a formed image.

It is known in the art that temperature at the time of the fixation of toner, which is referred to as fixation temperature, is closely related to the degree of brilliancy, that is, the glossiness, of an image that is formed on a recording target medium. FIG. 6 shows relationships between the fixation temperature and the degree of brilliancy of a formed image. Generally speaking, the degree of brilliancy of a formed image tends to increase as the fixation temperature becomes higher. Lines A' and B' of FIG. 6 show, as the results of an experiment, relationships between the fixation temperature and the degree of brilliancy of an image that is formed as a result of image transfer that is performed with the use of two toners that are different from each other and two fixation apparatuses that are different from each other. As shown in FIG. 6, each of these lines indicates the tendency described above. From the results of this experiment shown therein, it is understood that the surface temperature of a sheet of recording paper at the time of image formation has an influence on the degree of brilliancy of an image formed thereon. Specifically, when the surface temperature of a sheet of recording paper has become high through a front-side image transfer fixation process in which printing is performed on the front side of a sheet of recording paper, the surface temperature thereof becomes even higher when the sheet of recording paper passes through the nip again in a reverse-side image transfer fixation process. As a result thereof, the degree of brilliancy of an image formed on the front of the sheet of recording paper differs from the degree of brilliancy of an image formed on the back thereof, which is not desirable. In order to ensure that the degree of brilliancy of an image formed on the front side of the sheet of recording paper does not substantially differ from the degree of brilliancy of an image formed on the reverse side thereof even when double side printing is performed, it is necessary to provide a configuration that controls the heating temperature of the printing paper at the time of the passage thereof through the nip. In addition, when a sheet of recording paper is heated rapidly, wrinkles may form thereon depending on the type of recording paper or use environment such as humidity or the like. In the configuration of an image formation apparatus according to the first example explained above, a plurality of heating members such as heaters is provided along the transportation channel/route/path of a recording target medium such as a sheet of printing paper. Heat is applied to the surface of a sheet of printing paper in an appropriate manner while differentiating double-side printing operation from one-side printing operation. In other words, heating for reverse-side printing is performed differently from heating for front-side printing. By this means, the surface temperature of a sheet of printing paper is adequately controlled. Therefore, an image formation apparatus according to the first example explained above makes it possible to achieve a uniform degree of brilliancy of an image formed thereon. In addition, the image formation apparatus according to the first example explained above makes it further possible to prevent any wrinkles from forming thereon. Thus, the image formation apparatus according to the first example is capable of outputting an image with high quality.

Second Example

In this example, an IOI color copy machine that is shown in FIG. 2 is used as an image formation apparatus. Image formation was performed under the same experimental conditions as those of the first example explained above except that the IOI color copy scheme is used in this second example. As the results of experiment, it was confirmed that there occurred no substantial difference between the quality of an image formed on the front side of the sheet of printing paper and the quality of an image formed on the reverse side thereof, both of which were excellent.

Third Example

Figure 7:
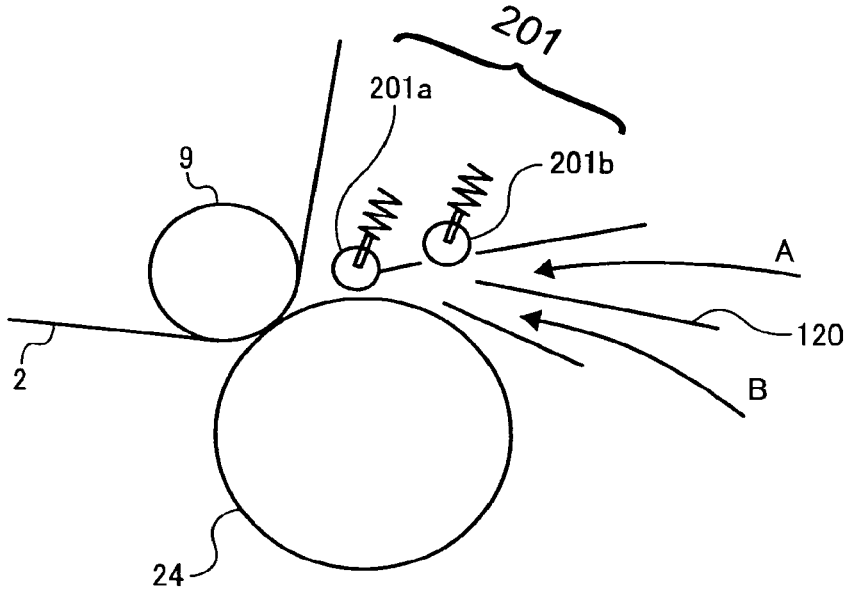
FIG. 7 is a diagram that schematically illustrates another example of the partial configuration of an image formation apparatus in the neighborhood of a nip where a plurality of heating members is provided.
Figure 8:
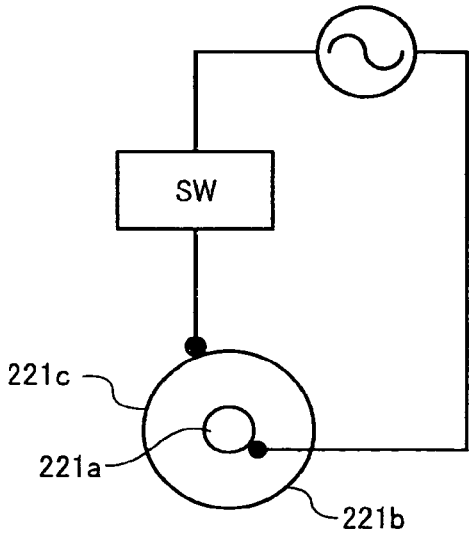
FIG. 8 is a diagram that schematically illustrates an example of the configuration of the heating members according to another example.
Figure 9:
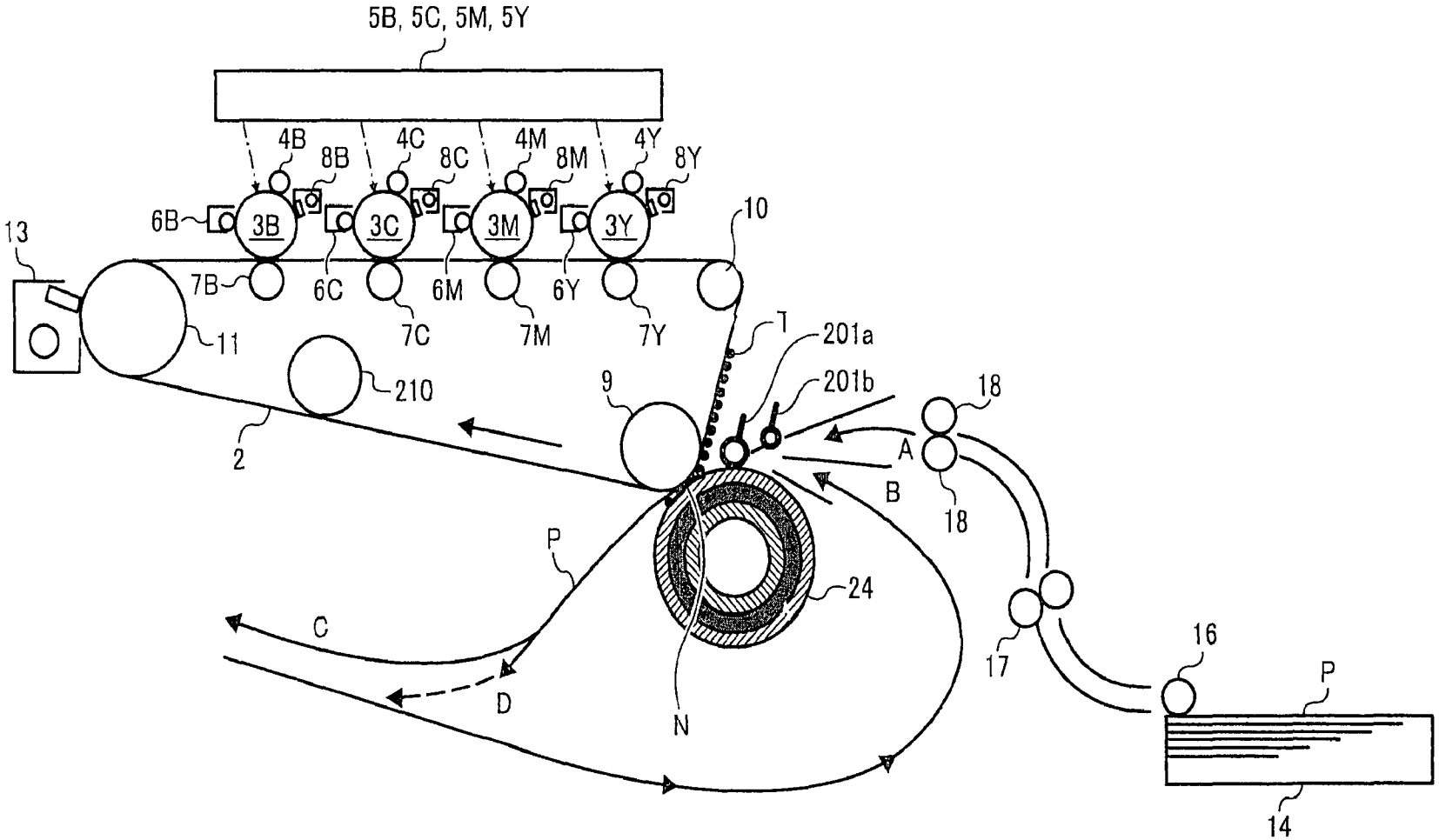
FIG. 9 is a diagram that schematically illustrates an example of the configuration of an image formation apparatus that is provided with an image transfer fixation apparatus according to an exemplary embodiment of the invention.

In this example, image formation was performed with the use of the image formation apparatus 1 that is shown in FIG. 1. In addition, a roller-type heating means, which has a roller structure, was used in an image transfer fixation process. FIG. 7 is a diagram that schematically illustrates an example of the partial configuration of an image formation apparatus in the neighborhood of a nip in an image transfer fixation process. FIG. 8 is a diagram that schematically illustrates an example of the configuration of a heating means 201. In the illustrated exemplary configuration, the heating means (e.g., heaters) 201 is provided at two relatively upstream positions (201*a* and 201*b*) when viewed from the nip, which is formed at a relatively downstream position, in the direction of transportation of a sheet of printing paper. Hereafter, the heating means 201 may be referred to as a pair of heaters 201*a* and 201*b*. As shown in FIG. 8, each of the heaters 201*a* and 201*b* has a roller axis 221*a* that is made of metal, a roller outer circumference 221*b* that is made of metal, and a semiconductor 221*c* that is formed between the metal roller axis 221*a* and the metal roller outer circumference 221*b*. When printing is performed on one face (i.e., the front side) of a sheet of recording paper, the sheet of recording paper travels on a one-side printing paper transportation channel that is shown by an arrow A in FIG. 7, as done in the first example explained above while referring to FIG. 5. The sheet of recording paper becomes in contact with both of the heaters 201*a* and 201*b* or comes very close thereto. As a result thereof, the surface of the sheet of printing paper is heated. Then, image transfer fixation is performed at the nip. When printing is performed only on one side of a sheet of recording paper, that is, not on both of two faces thereof, the print-completed paper is transported in the direction of paper ejection. Then, one-side printing operation ends. On the other hand, when image transfer fixation is performed on both of the front side and reverse side of a sheet of recording paper, after the completion of single side printing as explained above, the sheet of printing paper is transported in the direction D as shown in FIG. 9. Thereafter, the transportation direction of the sheet of printing paper is switched back. After the switchback, the sheet of printing paper is transported in the direction B shown in FIGS. 7 and 9. Then, the sheet of printing paper is fed again into the image transfer unit/portion. It is preferable that the aforementioned paper transport guide 120 should be provided so as to guide the sheet of recording paper in such a manner that, in the second feeding thereof to the nip for the reverse-side image transfer fixation, the paper transport guide 120 prevents the sheet of recording paper from becoming in contact with the heater 201*b* or coming very close to the heater 201*b*. Thereafter, image transfer fixation is performed at the nip. The print-completed paper is transported in the direction of paper ejection. Then, double-side printing operation ends.

Fourth Example

Figure 10:
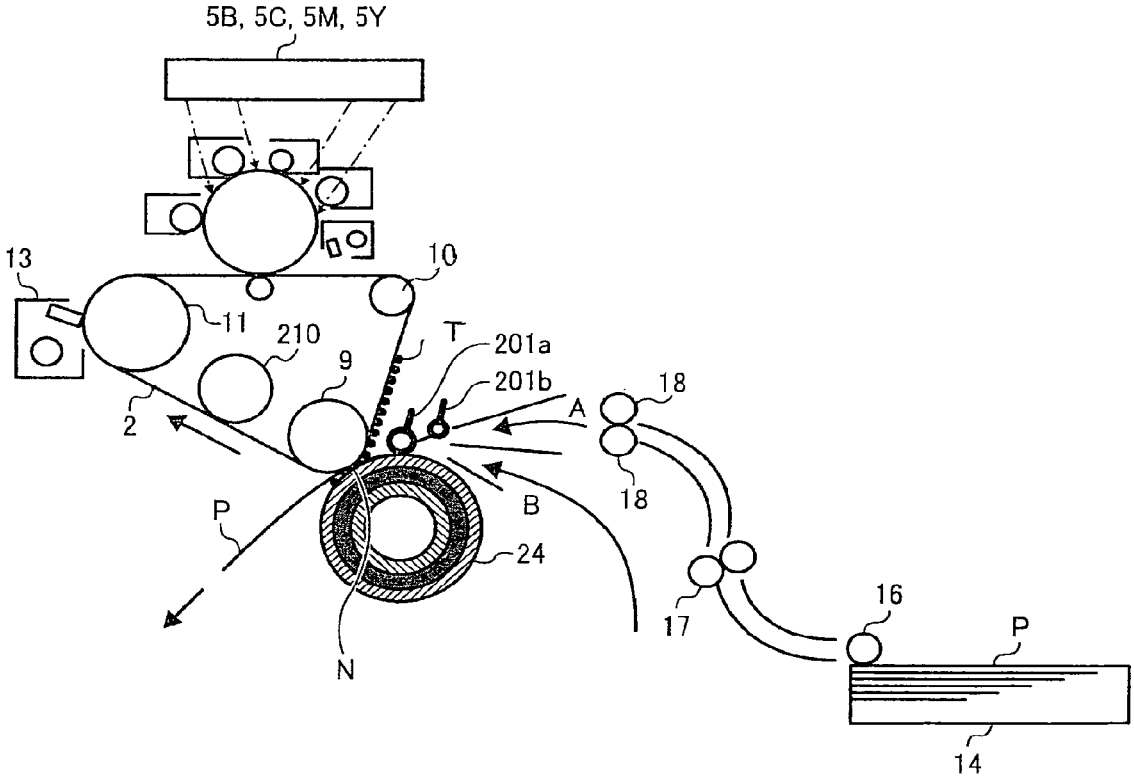
FIG. 10 is a diagram that schematically illustrates an example of the configuration of an image formation apparatus that is provided with an image transfer fixation apparatus according to another exemplary embodiment of the invention.

In this example, an IOI color copy machine that is shown in FIG. 10 is used as an image formation apparatus. Image formation was performed under the same experimental conditions as those of the third example explained above except that the IOI color copy scheme is used in this fourth example. As the results of experiment, it was confirmed that there occurred no substantial difference between the quality of an image formed on the front side of the sheet of printing paper and the quality of an image formed on the reverse side thereof, both of which were excellent.

Fifth Example

The conditions of controlling a pair of heating members that are provided at two places along the transportation channel/route/path of a recording target medium are experimentally studied. The conditions are explained below while referring to FIG. 5. When image formation is performed only on one face of a sheet of recording paper, the sheet of recording paper becomes in contact with both of the paper-transport-upstream-side heater 101*b* and the transfer-unit-side heater 101*a*, which is a paper-transport-downstream-side heater, or comes very close thereto. On the other hand, when image formation is performed on both of the front side and reverse side of a sheet of recording paper, in the reverse-side image formation process, the sheet of recording paper becomes in contact with the transfer-unit-side heater 101*a* only or comes very close thereto. If it is overheated when image transfer fixation is performed on the reverse side thereof, the degree of brilliancy of an image formed on the front thereof differs from the degree of brilliancy of an image formed on the back thereof, which is not desirable, because it has already been subjected to heating in the front-side printing process. Therefore, it is preferable to appropriately control the heating temperature of the transfer-unit-side heater 101*a*. In such heating temperature control, the paper-transport-upstream-side heater 101*b* is used as pre-heating means. Functioning as the pre-heating means, the paper-transport-upstream-side heater 101*b* makes up for the shortage of heating energy so as to achieve a uniform image transfer fixation temperature. Specifically, a voltage of AC 100V was applied between the aforementioned two electrodes 211 and 213 of the heating means 101 that is shown in FIG. 3. As the temperature exceeds 200° C., which is the Curie point of the semiconductor thereof, it was experimentally confirmed that an inter-electrode resistance increased sharply and that a current level was reduced to a half at 210° C. and to a quarter at 220° C. That is, it is possible to appropriately control heating temperature and temperature rising rate by appropriately selecting the semiconductor, appropriately adjusting the Curie point thereof, and appropriately changing the level of a voltage applied thereto.

Sixth Example

In a case where the speed of the transportation of a sheet of recording paper is low, and thus there is a certain time lag between the front-side image transfer fixation process and the reverse-side image transfer fixation process, the heating temperature of the heating means in each image transfer fixation process may be changed. Such a change can be applied to both of a tandem color copy scheme/method shown in FIG. 1, which is an example of image transfer fixation according to the first embodiment of the invention, and an IOI color-superposition copy scheme/method shown in FIG. 2, which is an example of image transfer fixation according to the second embodiment of the invention. Especially, it offers a greater space-saving advantage if applied to the IOI color-superposition copy machine shown in FIG. 2, which is an example of an image formation apparatus according to the second embodiment of the invention that forms a color-superposed image on a single photosensitive member thereof by superposing an image corresponding to one color on an image corresponding to another color. As has already been explained above, in the single-photosensitive-member color-superposition scheme/method, a series of image formation process, which includes an electrification step, an exposure step (i.e., writing step), and a development step, is executed on a single photosensitive member for each toner color component. The single-photosensitive-member color-superposition scheme/method offers faster response. In addition, since the IOI color-superposition copy machine has only one photosensitive member, it offers another advantage of machine cost reduction.

In each of the foregoing exemplary embodiments of the invention, it is explained that the image transfer fixation unit/portion has a roller structure. However, the scope of these aspects of the invention is not limited to such an exemplary configuration. For example, the same advantageous effects as those explained above can be produced when the image transfer fixation unit/portion has a belt structure. In addition, the direction of paper transportation is not limited to a specific example that is explained in the foregoing exemplary embodiments of the invention. For example, a sheet of printing paper may be transported in a diagonally upward direction from the lower left part of the sheet of FIG. 1. Such a modified paper transport direction can be achieved by changing, for example, the direction of image formation and/or the position of image formation as well as the rotation direction of an intermediary image transfer medium.

Next, an example of toner that can be suitably applied to image formation that is performed with the use of an image formation apparatus that is provided with an image transfer fixation apparatus according to an aspect of the invention is explained below. It is known in the art that the performance of the transferring of toner (i.e., a toner image) from the intermediary image transfer belt 2 to an image transfer fixation member including but not limited to image transfer efficiency and image transfer fidelity (i.e., faithfulness) has an influence on image quality. In addition, it is further known in the art that the performance of image transfer depends on the form of toner particles. It was experimentally confirmed that, in order to optimize the form of toner particles, toner should preferably have Wardell's spheroidicity of 0.8 or larger. The Wardell's spheroidicity, that is, the degree of sphericity, is denoted as $\phi$ herein. The Wardell's degree of sphericity $\phi$ can be calculated using the following formula: $\phi$=Diameter of a circle having an area equal to a particle-projected area/Diameter of a circle that is circumscribed with a particle-projected image. The calculation of the Wardell's degree of sphericity can be performed as follows. A suitable amount of toner is placed as a sample on a glass slide (i.e., slide glass). Then, one hundred random sample toner particles are measured by means of a microscope with a magnification of ×500. Preferable toner described above makes it possible to increase secondary image transfer efficiency, thereby improving image quality.

What is claimed is:

1. A transfer fixation apparatus for transferring a toner image onto a recording target medium and fixing the toner image on the recording target medium, comprising:

a fixing member that carries the toner image;

a pressurizing member that presses against the fixing member with pressure so as to form a nip through which the recording target medium is transported; and a heating section that is made up of a plurality of heating members that are provided at relatively upstream positions relative to the nip, the plurality of heating members applying heat to a surface of the recording target medium that is transported toward the nip, wherein a number of heating members that apply heat to the surface of the recording target medium is changed depending on whether a transfer of the toner image is performed only on a front side of the recording target medium or the transfer of the toner image is performed also on a reverse side of the recording target medium after the transfer of the toner image on the front side of the recording target medium and the plurality of heating members can be controlled independently of each other or one another.

2. The transfer fixation apparatus according to claim 1, wherein the number of heating members that apply heat to the surface of the recording target medium when the transfer of the toner image is performed only on the front side of the recording target medium is larger than a number of heating members that apply heat to the surface of the recording target medium when the transfer of the toner image is performed on the reverse side of the recording target medium after the transfer of the toner image on the front side of the recording target medium.

3. The transfer fixation apparatus according to claim 1 wherein the number of heating members that apply heat to the surface of the recording target medium is changed by switching transport paths of the recording target medium depending on whether the transfer of the toner image is performed only on the front side of the recording target medium or the transfer of the toner image is performed also on the reverse side of the recording target medium after the transfer of the toner image on the front side of the recording target medium.

4. The transfer fixation apparatus according to claim 1, wherein a heating temperature of the heating section in each image transfer fixation process is changed if there is a certain time between the front-side image transfer fixation and the reverse-side image transfer fixation.

5. The transfer fixation apparatus according to claim 1, wherein the plurality of heating members applies heat to the surface of the recording target medium by one of contacting the recording target medium and not contacting the recording target medium.

6. The transfer fixation apparatus according to claim 1, wherein the plurality of heating members are separated from each other as viewed in a width direction of the recording target medium.

7. An image formation apparatus comprising:

a single photosensitive member; and the transfer fixation apparatus according to claim 1, wherein the image formation apparatus forms a color-superposed toner image on the single photosensitive member by superposing a toner image corresponding to one color on a toner image corresponding to another color.

8. An image formation apparatus that is provided with the transfer fixation apparatus according to claim 1, wherein the toner has Wardell's degree of sphericity of at least 0.8.

9. The transfer fixation apparatus according to claim 1, wherein the plurality of heating members includes a plurality of thermistors arranged in a line, the thermisotors being arranged between a first electrode and a second electrode, the first and second electrodes being common to the plurality of thermistors, and one of the electrodes is configured transmit heat to the recording target medium.

10. The transfer fixation apparatus according to claim 1, wherein the plurality of heating members includes a plurality of thermistors arranged in a line and each of the plurality of thermistors includes an individual electrode thereon.

* * * * *